United States Patent [19]

Coles

[11] 4,402,500

[45] Sep. 6, 1983

[54] AMUSEMENT DEVICE FOR SIMULATING WEIGHTLESSNESS

[76] Inventor: William E. Coles, 4201 Topanga Canyon Blvd. #174, Woodland Hills, Calif. 91364

[21] Appl. No.: 227,792

[22] Filed: Mar. 27, 1981

[51] Int. Cl.[3] ..... A63G 1/12

[52] U.S. Cl. ..... 272/33 R; 272/36; 272/132; 434/55

[58] Field of Search ..... 272/33 R, 36, 115, 109, 272/1 R, 1 C, DIG. 4; 434/55, 57

[56] References Cited

U.S. PATENT DOCUMENTS

| | | | |
|---|---|---|---|
| 3,083,037 | 3/1963 | Gordon et al. | 272/115 X |
| 3,141,669 | 7/1964 | Chul | 272/36 |
| 3,164,382 | 1/1965 | Johnson | 272/33 R |
| 3,197,203 | 7/1965 | Tieman | 272/33 R |
| 3,276,777 | 10/1966 | Pruitt, Sr. | 272/36 X |

FOREIGN PATENT DOCUMENTS

| | | | |
|---|---|---|---|
| 2023257 | 2/1972 | Fed. Rep. of Germany | 272/33 R |
| 1528350 | 10/1978 | United Kingdom | 272/33 R |

*Primary Examiner*—Richard C. Pinkham
*Assistant Examiner*—Arnold W. Kramer
*Attorney, Agent, or Firm*—Roger A. Marrs

[57] ABSTRACT

A combined spinning and rotating amusement device is disclosed herein for simulating weightlessness which includes a circular base having upright spaced apart stanchions between which is rotatably and spinably mounted, a seat intended to be occupied by the user. The spinning and rotating means includes a rotatable portion mounted between the stanchions by joints intended to permit rotation about a horizontal axis while the spinable portion is rotatably mounted on the rotating portion so as to rotate via joints about an axis normal to the axis of rotation of the rotatable portion. An adjustable brake mechanism is disposed to selectively operate manually between a selected one of the stanchions and the rotating device while a hand brake mechanism is operably connected between the spinning portion and the rotating portion for manually controlling the spinning portion by the user.

1 Claim, 8 Drawing Figures

FIG. 1
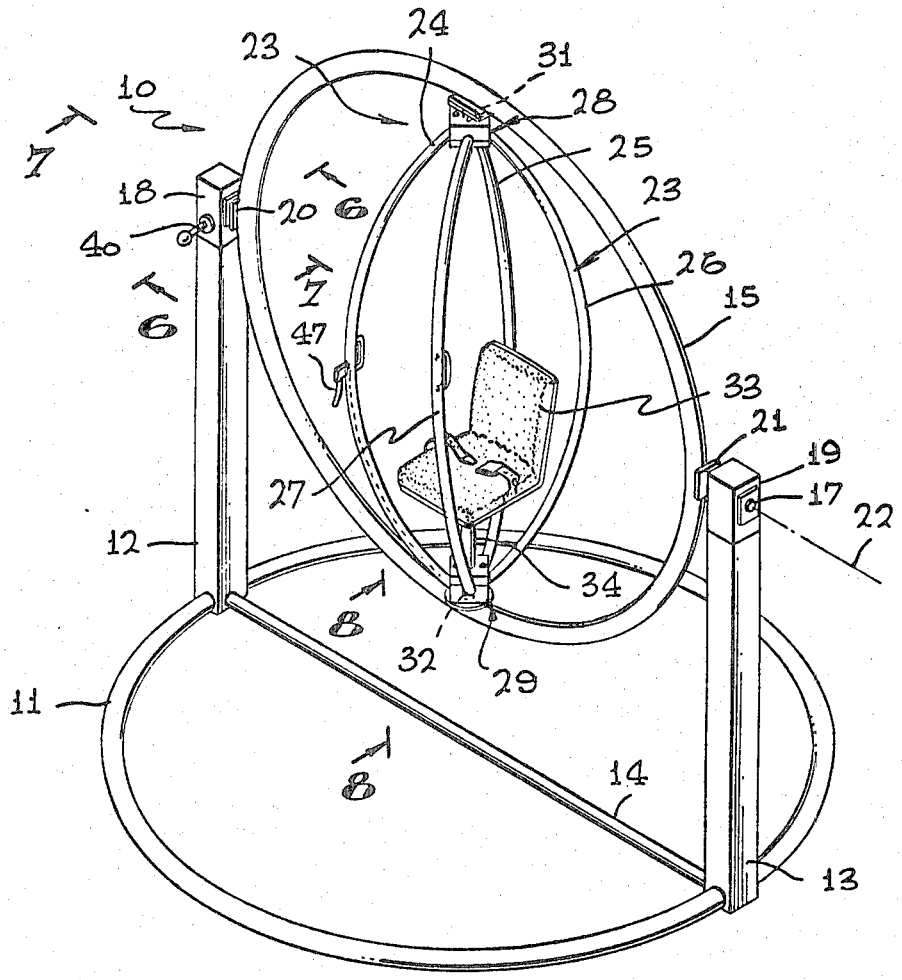
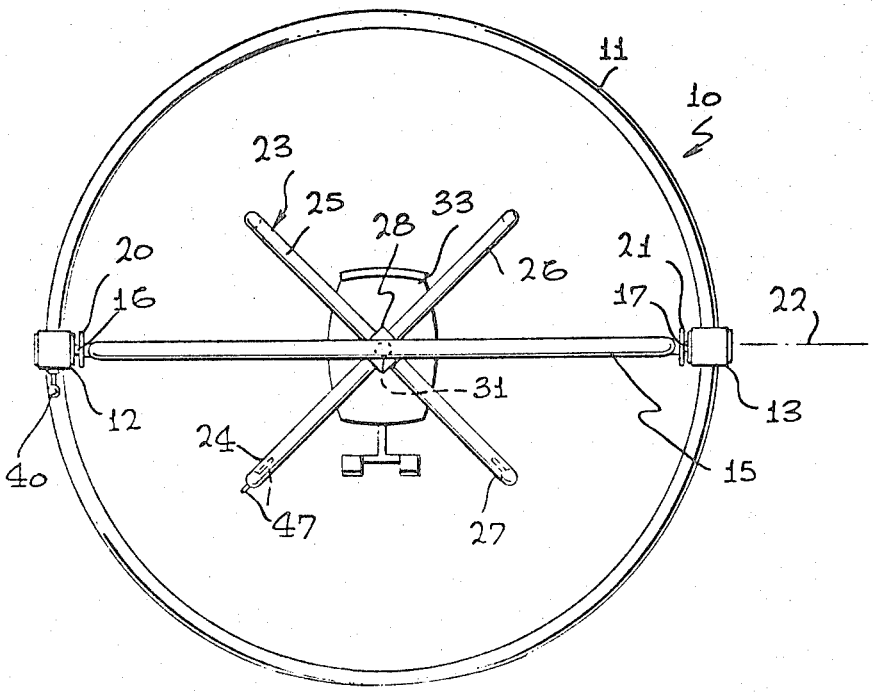
FIG. 2

AMUSEMENT DEVICE FOR SIMULATING WEIGHTLESSNESS

BACKGROUND OF THE INVENTION

1. Field of the Invention

The present invention relates to amusement and/or exercise devices and, more particularly, to a novel device in which an occupant may be simultaneously spun about one axis and rotated about another axis normal thereto so that the occupant experiences simulated weightlessness.

2. Brief Description of the Prior Art

The general public has become aware in recent years of the condition of weightlessness to which all objects and passengers in satellites and other flying objects are subjected. It is generally known that astronauts as well as other flyers are prepared in advance to cope with this condition by placing them in apparatus in which some of the aspects of weightlessness are simulated.

Attempts have been made to create simulating machines which will reproduce the effects of weightlessness and the foremost of these machines operate on a centrifugal force principle in which the occupant rides in a seat carried on the outward end of a rotating arm. Although such a device is operable for its intended purpose, the machine is expensive and requires skilled persons to operate the controls and to monitor the proceedure. In other devices, such as of the amusement type, passengers ride in rotating and spinning cars which are carried on opposite ends of a rotating arm. However, this device requires an operator to handle the controls and to monitor the action. Also, the occupants of the cars have no control over the proceedure or operations of the machine so that full reliance is assumed by the non-participating operator.

Therefore, a long standing need has existed to provide a weightlessness simulating apparatus which not only rotates and spins the occupant about axis normal to each other but which also provides basic controls which are operated by the occupant.

SUMMARY OF THE INVENTION

Accordingly, the above problems and difficulties are obviated by the present invention which provides a novel amusement and/or exercise device which includes a base having spaced apart and upright stanchions rotatably supporting a ring constituting a rotating portion for rotating about a horizontal axis. The rotating portion further includes a spinning portion which spins about an axis normal to the horizontal axis within the perimeter of the ring so that simultaneous spinning and rotation is achieved. A seat is disposed on the spinning portion intended to be occupied by a person using the device and a breaking means is provided for the occupant for controlling the speed of spinning. The breaking means cooperatively interconnects the spinning means with the ring of the rotating means. Additional adjustable breaking means are provided for controlling the speed of rotation of the ring with respect to the supporting stanchions.

Therefore, it is among the primary object of the present invention to provide a novel device suitable for use in amusement or exercise areas that will enable an occupant to experience some of the weightlessness sensations.

Another object of the present invention is to provide a novel amusement device for simulating weightlessness which does not depend upon a nonparticipating operator or controller, but which provides mechanisms for controlling speed operable by the user or occupant of the device.

Still a further object of the present invention is to provide a novel amusement device for simulating weightlessness which is comparatively economical to manufacture and which may be used and enjoyed by one not having substantial or critical technical skill.

Still a further object of the present invention is to provide a device of the type described herein that will require neither pedaling devices nor an external source of power to orient the occupant or passenger in a variety of positions in order to provide the passenger or occupant with sensations that will approximate those prevailing in an earth satellite.

Yet another object of the present invention is to provide a means for positioning a seat or other components of the apparatus such that the occupant of the seat will be able to initiate a roll in any direction or orientation merely by appropriate body movements.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is a front perspective view showing the novel amusement device of the present invention preparatory for use;

FIG. 2 is a top plan view of the amusement device shown in FIG. 1;

DESCRIPTION OF PREFERRED EMBODIMENT

Figure 3:
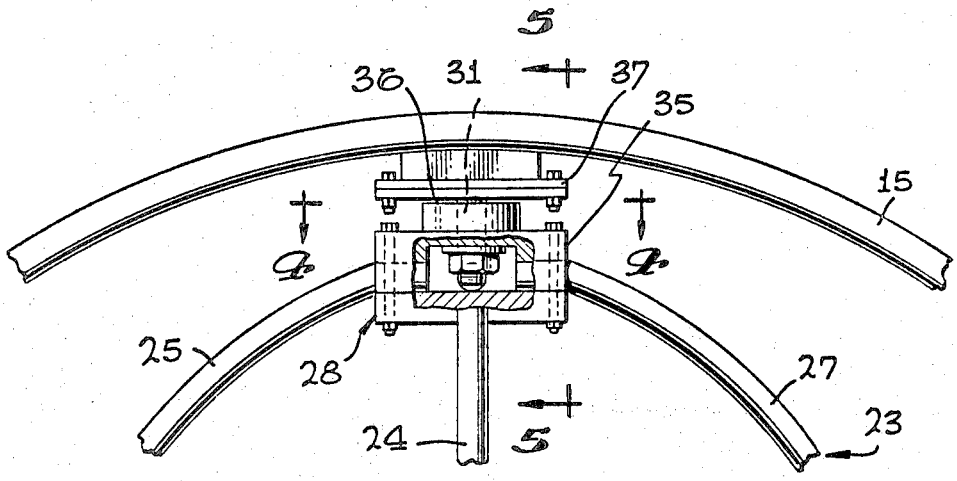
FIG. 3 is a fragmentary elevational view illustrating the articulated joint interconnecting the spinning portion of the device with the rotating loop portion.

Referring to FIG. 1, the novel amusement and/or exercise device of the present invention is indicated in the general direction of arrow 10 which includes a base or pedestal 11 supporting the apparatus and which includes a pair of upright 12 and 13 which are arranged on opposite sides of the base 11. A rigid support or brace 14 interconnects the stanchions 12 and 13 at their ends suitably connecting with the base 11. The opposite free ends of the stanchions 12 and 13 movably support a rotating portion and a spinning portion. The rotating portion comprises a ring 15 rotatably attached at its opposite sides to the stanchions 12 and 13 respectively so that it will rotate around a horizontal axis that passes through opposite sides of the ring and through stub shafts or spindles 16 and 17. Each of the shafts or spindles are carried by block members 18 and 19 respectively which are appropriately secured to the top ends of the upright stanchions 12 and 13. These may be firmly imbedded in the ground or appropriately anchored. If the installation is to be a permanent one, the stanchions and the anchor ring 11 may be imbedded in the ground.

The block members 18 and 19 may of course contain suitable bearings for the stub shafts of spindles 16 and 17, or the parts may be reversed so that the stub shafts are integral with respect to the blocks 17 and 18 while the shafts or spindles are connected to the opposite sides of the ring 15 by suitable clamp-type fixtures 20 and 21 respectively.

The ring 15 may be composed of one, two or four parts. The ring is fabricated from a single rod or tube, it can be extended through appropriate holes in three of the four blocks or fixtures and the ends may be secured, as by welding, to the final or fixture. If the ring 15 is composed of two arcuate members of substantially 180°, the ends may be secured either in blocks or fixtures as appropriate. The blocks and fixtures will be described later with respect to other figures.

As described, it can be seen that the rotating portion including ring 15 rotates about a horizontal axis identified by numeral 22 between the upright stanchions 12 and 13. Rotation may be achieved in either a clockwise or counter-clockwise direction.

In addition to the rotating portion including ring 15, a spinning portion is provided comprising a frame or cage illustrated generally in the direction of arrow 23. The frame or cage 23, mounted within the ring 15 in a manner hereandafter to be described, may be formed of arcuate rods that may be comprised of segments of circles or merely rods which are arcuately formed. Alternate embodiments of the invention may be provided in which the frame 23 consists of only two outwardly bowed members or there may be three or more; but in the preferred embodiment illustrated in the figures, the frame or cage 23 comprises four arcuate members 24, 25, 26 and 27 respectively. The lower ends of these four rods or tubes are appropriately secured, as by welding, to a block 29 at its upper end and a block 28 at its lower end. Each block carries a stub shaft 31 and 32 respectively which may be journaled respectively in the associated block which are integrally secured as a unitary structure to the ring 15 at positions thereon which are diametrically opposed. A seat 33 is attached to the lower weldment of the frame by a post 34 and the seat may include suitable safety straps or belts to hold the occupant in place during the use of the device.

In the orientation of the components and parts as they are shown in FIG. 1, the stub shafts 31 and 32 provide a vertical axis. However, if the ring 15 were turned 90° around the horizontal axis that passes through the members 12 and 13, then the axis which passes through the stub shafts 31 and 32 would also be horizontal. In the embodiment as illustrated, the frame 23 consists of the arcuate rods or tube 24–27 inclusive may be considered as a cage within which the seat 33 is appropriately mounted for rotation with the frame 23 about an axis which in the orientation shown in FIG. 1 is vertically disposed.

Referring now to FIG. 2, it can be seen that the frame or cage 23 is totally encircled by the ring 15 so that the movement of the frame 23 is a spinning motion within the confines of the inner diameter of ring 15. The axes of rotation for both the ring 15 and the frame 23 are 90° from each other or normal to each other.

Figure 4:
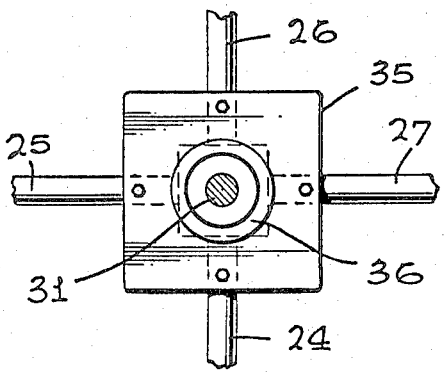
FIG. 4 is a transverse cross-sectional view of the articulated joint shown in FIG. 3 as taken in the direction of arrows 4—4 thereof.
Figure 5:
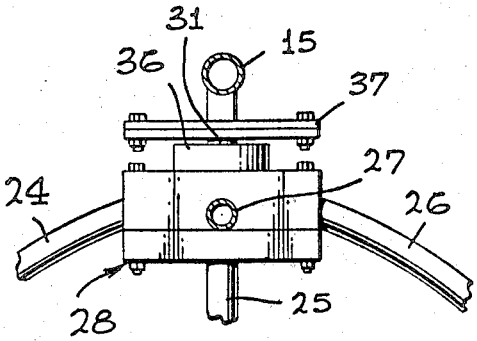
FIG. 5 is a longitudinal cross-sectional view of the joint shown in FIG. 3 as taken in the direction of arrows 5—5 thereof.

Referring now in detail to FIG. 3, it can be seen that the opposite ends of the rods or tubes, such as represented by numerals 25 and 27, are joined by a clamp or fixture 35. Also, the opposite ends of the tubes comprising the frame are joined in block 28. A suitable bearing 36 mounts shaft or spindle 31 so that rotation may occur. The shaft 31 is depending from a weldment 37 carried on the inside diameter of the ring 15. Therefore, it can be seen that the frame 23 rotates with respect to the inside diameter of the ring 15 by virtue of the shaft 31 rotatably carried within the bearing 36 on the block 28. This relationship is also shown in the cross-sectional view of FIG. 4 wherein the bearing 36 and the frame members 24–27 inclusive, including the block 28 all rotate about the shaft 31. FIG. 5 also shows a similar relationship since the cross-sectional view shown therein is normal to the view shown in FIG. 4.

Figure 6:
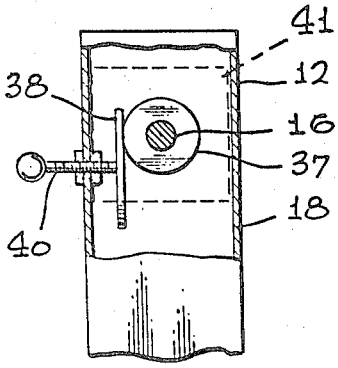
FIG. 6 is a cross-sectional view of the hoop or ring illustrating brake adjusting means therefore as taken in the direction of arrows 6—6 of FIG. 1.
Figure 7:
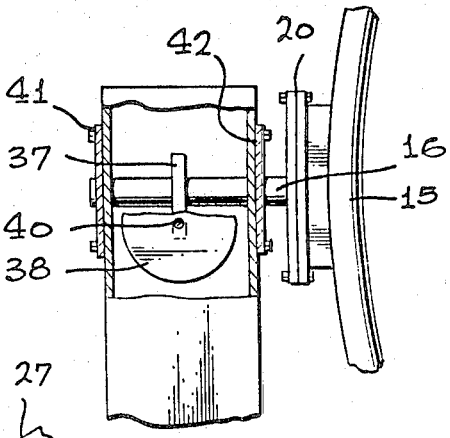
FIG. 7 is a cross-sectional view of the rotating joint interconnecting the hoop or ring with the stanchion as taken in the direction of arrows 7—7 in FIG. 1.

Referring now in detail to FIG. 6, a brake is illustrated for adjusting the speed of the ring 15 rotation about its horizontal axis. Shaft 16 is employed to mount a brake disc 37 which is adjustably and selectively engageable by the surface of a shoe 38 when the screw 40 is moved inwardly. As the screw is adjusted within its threaded engagement with the stanchion or post 12, the brake shoe 38 comes into contact with the disc 37 and friction develops. The more that the brake shoe is tightened against the break disc, the slower the speed of ring 15 rotation. It is to be understood that this brake adjustment is manual and is adjustable by the user prior to his occupying the seat 33. FIG. 7 further shows the mounting of the brake disc 37 on the shaft 16. Suitable bearings 41 and 42 rotate the shaft on the post or stanchion 12.

Figure 8:
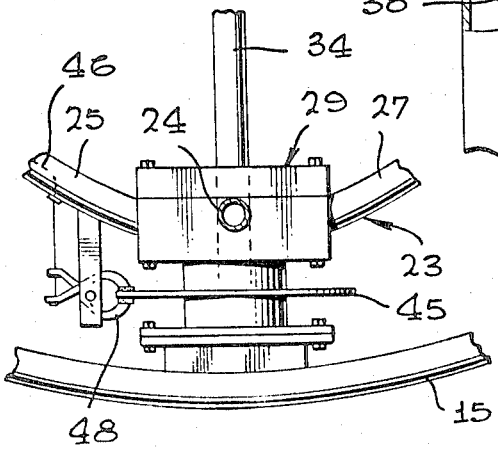
FIG. 8 is a fragmentary view of the articulated joint joining the spinning portion with the rotating hoop or ring and illustrating the manual hand brake mechanism therefore as taken in the direction of arrows 8—8 of FIG. 1.

Referring now in detail to FIG. 8, it can be seen that the lower mounting of the frame 23 to the ring 15 includes a caliper-type brake which includes a brake disc 45 which is fixedly carried on the block 29 welded to the inside diameter of the ring 15. Cable 46 is attached at one end to a handgrip 47, as shown in FIG. 1 on arcuate tube 24, while its opposite end is operably coupled to a pair of calipers 48 carried on the tube 25 for pivoting purposes. As the handgrip 47 is depressed by the occupant of the seat 33 during a ride, the calipers will come together against the disc 45 and slow the speed of frame or cage 23 spinning. Therefore, the speed of cage spinning is under the direct control of the user at all times.

Therefore, in view of the foregoing, it can be seen that a novel amusement and/or exercise device is provided incorporating the inventive concept. The device or apparatus may be placed on any suitable supporting surface and the person intending to enjoy a "ride" mounts the apparatus by sitting in seat 33 and buckling himself therein. The occupant of the seat 33 may grasp the tubes of the frame with his hands or, if the occupant desires to control the speed on spin, he may grasp the handle 47 and rod 24 with one hand. After initially adjusting the friction of the shoe 38 against the brake disc 37, the user may now exert a force on the apparatus by throwing his body in one direction and then another.

In order to turn the frame or cage 23 in a clockwise direction, the pressure is exerted by throwing the body in such a direction that a turning moment will be supplied by the right foot against its support on the tube 24. If the occupant desires the frame to rotate in a counterclockwise direction, an appropriate force may be applied against the tube 27 by the left foot. Other turning moments may be applied by the feet against the intervening sections and tubes. The device may also be maneuvered by quickly throwing the body so that the center gravity is displaced in such a manner that appropriate turning moments are directed against the members 25 and 26. By leaning the body forward, backward or sideways, the ring 15 carrying the cage 23 and the seat 33 with it, may be rotated around the permanently horizontal axis that passes through the stub shafts 16 and 17.

It will be seen that the construction of this apparatus or device is such that the body may be placed in rolls or maneuvered in a variety of directions simulating the floating of the body in portions of space where the centrifugal forces of a satellite neutralize gravity.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A device for simulating weightlessness comprising:

a base;

a ring supported for rotation on a horizontal axis;

a frame supported by said ring for rotation on a second axis at right angles to said horizontal axis;

a passenger seat so supported by said frame for rotation therewith that at least one of said axes will pass through the body of a passenger occupying said seat;

said frame comprising portions that are gripable by a passenger occupying said seat;

means for securing a passenger to said seat so confining the passenger's feet each within a different restricted area that a force may be directed against said frame in either of two directions by the passenger's feet whereby said portions being so disposed that reactive forces produced by movements of the passenger's body will be transmitted to said frame and ring;

said portions include handles attached to adjoining parts of the frame at spaced positions;

said frame comprises a pair of circular members coupled together at right angles surrounding said seat and pivotally connected to the inside of said ring as a unitary revolving cage;

said seat is so located that both of said axes will pass through the body of the passenger or such person as may be occupying said seat;

a pair of blocks are secured to said ring at diametrically opposite positions having said second axis passing therethrough;

said cage comprises (a) a pair of hubs each having a stub shaft journaled in one of said blocks and (b) a pair of outwardly bowed bars constituting one of said pair of circular members each having one end rigidly affixed to one of said hubs and the other end rigidly affixed to the other of said hubs;

a second pair of outwardly bowed bars constituting the other of said pair of circular members, each having one end rigidly affixed to one of said hubs and the other end rigidly affixed to the other of said hubs, the seat being mounted within said cage provided by said pairs of bars;

said ring rotatably mounted on said base by means of a pair of supports located on opposite sides of said ring, each of said supports comprising an upright post and a bearing member secured thereto, said horizontal axis passing through said bearing members;

brake mechanism operably coupled between said cage and said ring for manually controlling the speed of movement of said cage relative to said ring; and adjustable friction means interconnecting said ring with a selected one of said upright posts for selectively restricting the movement of said ring with respect to said upright posts.

* * * * *